US005896762A

United States Patent [19]

Iidaka et al.

[11] Patent Number: 5,896,762

[45] Date of Patent: Apr. 27, 1999

[54] THEFT PREVENTING DEVICE

[75] Inventors: Toshiharu Iidaka, Kanagawa; Koji Umeda, Aichi, both of Japan

[73] Assignees: Alpha Corporation, Yokohama; G.K. Engineering Co., Ltd., Okazaki, both of Japan

[21] Appl. No.: 08/516,637

[22] Filed: Aug. 18, 1995

[30] Foreign Application Priority Data

Aug. 24, 1994 [JP] Japan ..... 6-199279

[51] Int. Cl.[6] ..... E05B 65/00

[52] U.S. Cl. ..... 70/57.1; 70/18; 70/53; 70/49; 109/34

[58] Field of Search ..... 70/18, 30, 49, 70/57.1, 53; 109/29, 30, 31, 33, 32, 34

[56] References Cited

U.S. PATENT DOCUMENTS

| | | | |
|---|---|---|---|
| 1,997,113 | 4/1935 | Lewis | 109/34 |
| 3,435,642 | 4/1969 | Del Pesco | 70/49 |
| 3,808,847 | 5/1974 | Vesely | 70/18 |
| 3,991,594 | 11/1976 | Goenner . | |
| 4,157,602 | 6/1979 | Pennell . | |
| 4,177,541 | 12/1979 | Seakan | 70/18 |
| 4,325,238 | 4/1982 | Scherbing . | |
| 4,483,049 | 11/1984 | Gustavsson et al. . | |
| 4,676,080 | 6/1987 | Schwarz . | |
| 4,698,620 | 10/1987 | Marshall . | |
| 4,712,394 | 12/1987 | Bull . | |
| 4,986,457 | 1/1991 | Faris | 70/57.1 |
| 5,412,959 | 5/1995 | Bentley | 70/30 |

FOREIGN PATENT DOCUMENTS

| | | |
|---|---|---|
| 91 11 001 U | 11/1991 | Germany . |
| 60-11975 | 1/1985 | Japan . |
| 63-201174 | 12/1988 | Japan . |
| 5-40561 | 6/1993 | Japan . |
| 6-33294 | 4/1994 | Japan . |

*Primary Examiner*—Darnell M. Boucher
*Attorney, Agent, or Firm*—Nikaido, Marmelstein, Murray & Oram LLP

[57] ABSTRACT

A theft preventing device comprises: a lock unit 11; and a coupling member 12 having both terminals 12*a* and 12*b* which are connected to the lock unit 11, at least one of the terminals being separable from the lock unit. In the device, the inside of the coupling member 12 is filled with a fluid including adhesive material, so that, when the coupling member 12 is damaged, the fluid is splashed out of the coupling member 12 whereby the adhesive material is stuck onto an object or objects around the device. Hence, from detection of the adhesive material, it can be determined who has broken it, and it can be confirmed that the lock unit has been locked.

9 Claims, 9 Drawing Sheets

THEFT PREVENTING DEVICE

BACKGROUND OF THE INVENTION

1. Field of the Invention

This invention relates to theft preventing devices, and more particularly to a theft preventing device which, when unlawfully damaged, splashes out a fluid containing adhesive material.

2. Description of the Conventional Art

For instance, U.S. Pat. No. 4,483,049 has proposed a theft preventing device which is designed as follows: The device has a material which is permanently stuck on an object or produces a strong smell. The material is fixedly stuck onto cloth, leather, leather goods, or objects made of cloth or leather. When an excessively great external force is applied to the theft preventing device, its closed space is broken, as a result of which the adhesive material or smelly material is discharged from the closed space, which prevents the theft of the article to which the theft preventing device is applied.

On the other hand, Unexamined Japanese Utility Model Publication Hei-6-33294/(1994) has disclosed a portable crime preventing device which discharges small pieces such as confetti so that they are stuck onto the person. The portable crime preventing device comprises; an accommodating case which has a blowing hole, and accommodates a number of small pieces such as confetti and a rotary wing, and a drive section for rotating the rotary wing in the accommodating case. When the switch is operated, the drive section is activated, so that the rotary wing is turned to discharge the small pieces out of the device.

A two-wheeled vehicle such as a bicycle and a motorcycle often employs a wire lock device in which a wire is detachably connected to a lock unit. However, since the wire can be cut, it is impossible to prevent the two-wheel vehicle from being stolen.

SUMMARY OF THE INVENTION

In view of the foregoing, an object of the invention is to provide a theft preventing device which is so designed that, when a coupling member connected, like a loop, to a lock unit is unlawfully damaged, a fluid containing adhesive material is splashed out of the coupling member.

A theft preventing device according to the invention comprises: a lock unit; and a coupling member having both terminals which are coupled to the lock unit in such a manner that the coupling member is in the form of a loop, at least one of the terminals being separable from the lock unit. In the device, the inside of the coupling member is filled with a fluid containing adhesive material, so that, when the coupling member is damaged, the fluid is splashed out of the coupling member. In the device, the lock unit has two coupling holes, and the two terminals of the coupling member are detachably connected to the lock unit. The coupling member comprises a tube having a plurality of cover layers, and the tube is filled with the fluid. The plurality of cover layers are composed of a steel wire layer, a mesh layer, and an outer resin cover layer which are formed on the tube in the stated order.

Further in the device, the coupling member comprises a first coupling section made of metal, and a second coupling section smaller in diameter than the first coupling section. The first coupling section has a plug at one end which is detachably connected to one of two coupling holes of the lock unit, and an engaging recess at the other end. The second coupling section has a plug at one end which is detachably connected to the other coupling hole of the lock unit, and a key-type terminal at the other end which is inserted into the engaging hole of the first coupling member.

Further, the first coupling section is made solid by using a metal. When the fluid is supplied into the second coupling section through a valve provided in the key-type terminal of the second coupling section, the plug of the coupling section prevents the leakage of the fluid from the second coupling section. The key-type terminal has a pair of lugs, while the engaging recess of the first coupling section has a pair of cuts. The plug of the first coupling section is engaged with the one coupling hole of the lock unit, and the key-type terminal is inserted into the engaging recess, and thereafter the second coupling section is turned with respect to the first coupling section, and the plug of the second coupling section is engaged with the other coupling hole of the lock unit. The tube provided inside the coupling member is filled with the fluid, and a reinforcing wire is inserted into the tube. The fluid is liquefied petroleum gas (LPG) or smelly gas, and the adhesive material is paint, dye or pigment. The plug includes a check valve.

If the coupling member, which is engaged with the lock unit while forming a loop, is unlawfully damaged by a person, the fluid containing the adhesive material is splashed out, so that the adhesive material sticks onto him. Therefore, from detection of the adhesive material, it can be determined who has broken it, and it can be confirmed that the lock unit has been locked.

DETAILED DESCRIPTION OF PREFERRED EMBODIMENTS

The invention will be described with reference to its preferred embodiments shown in the accompanying drawings.

First Embodiment

FIGS. 1 through 5 shows an example of a theft preventing device, which constitutes a first embodiment of the invention.

Figure 4:
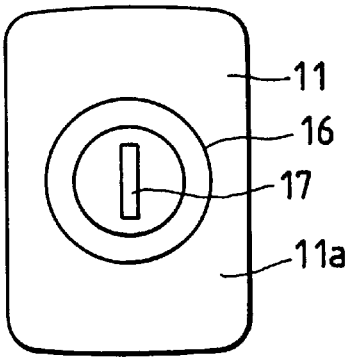
FIGS. 4 and 5 are a plan view and a side view, respectively showing the lock unit.
Figure 5:
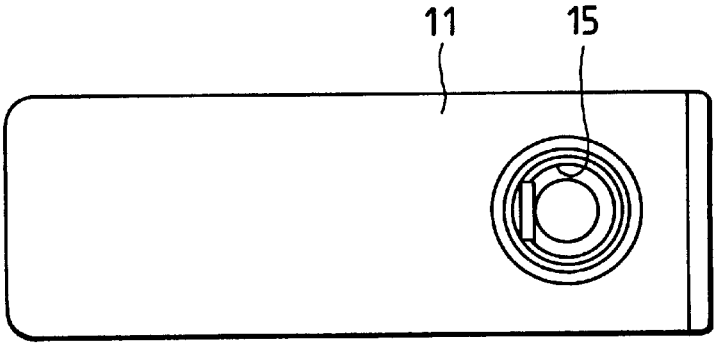
Figure 6:
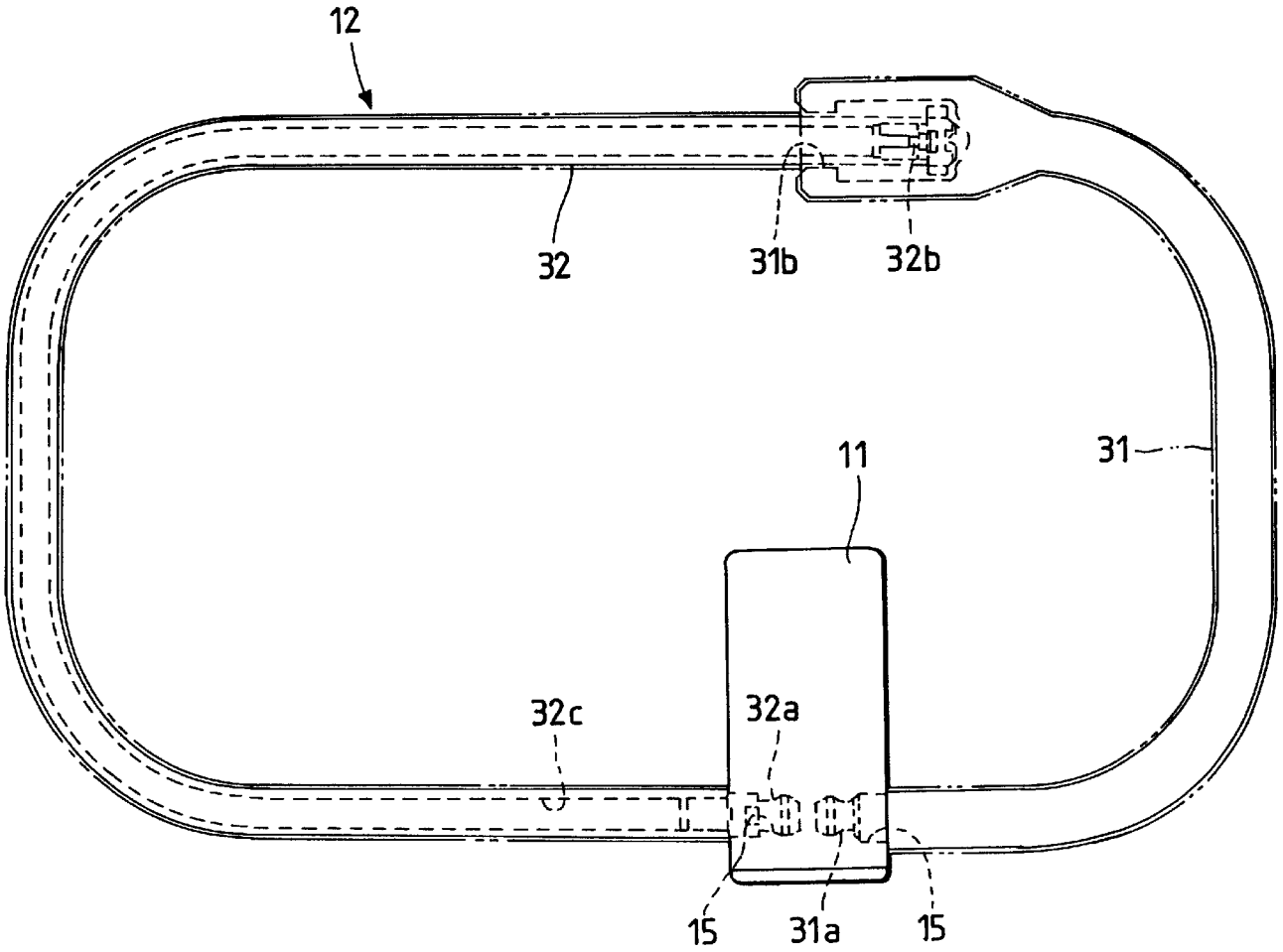
FIG. 6 is a front view showing another example of the theft preventing device, which constitutes a second embodiment of the invention.
Figure 7:
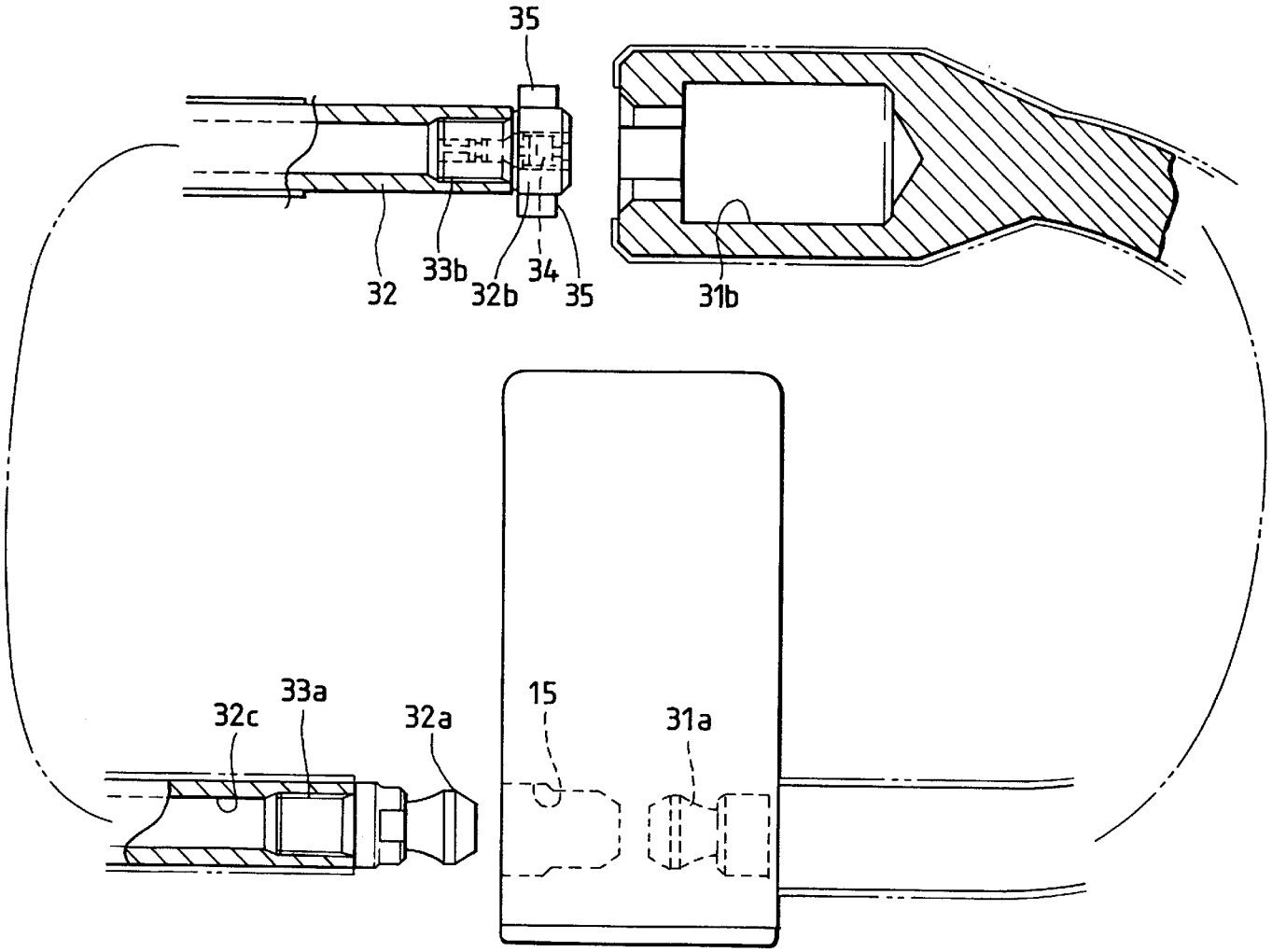
FIG. 7 is an enlarged fragmentary view showing the connection of a lock unit and a coupling member in the theft preventing device illustrated in FIG. 6.
Figure 8:
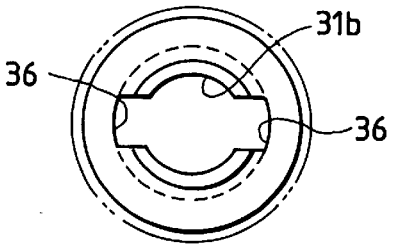
FIG. 8 is a front view showing an engaging recess formed in a first coupling section in the theft preventing device illustrated in FIG. 6.
Figure 9:
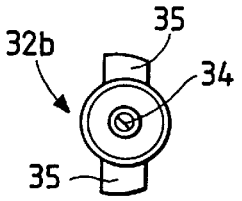
FIG. 9 is a front view of a key-type terminal of a second coupling section in the theft preventing device illustrated in FIG. 6.
Figure 10:
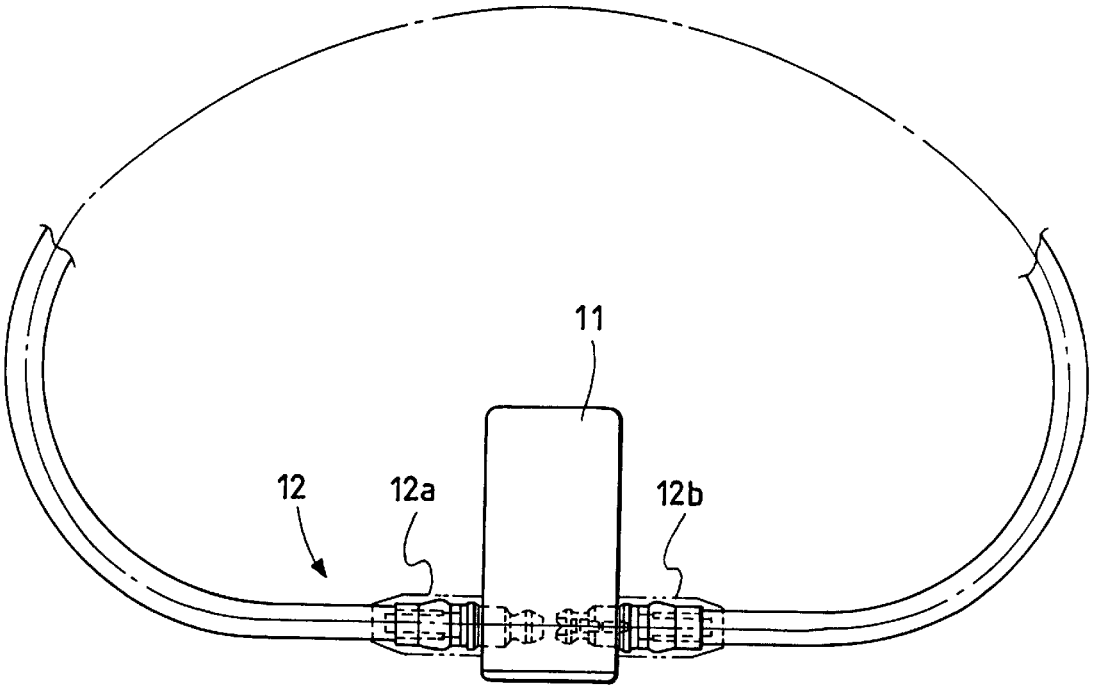
FIG. 10 is a front view showing another example of the theft preventing device, which constitutes a third embodiment of the invention.
Figure 11:
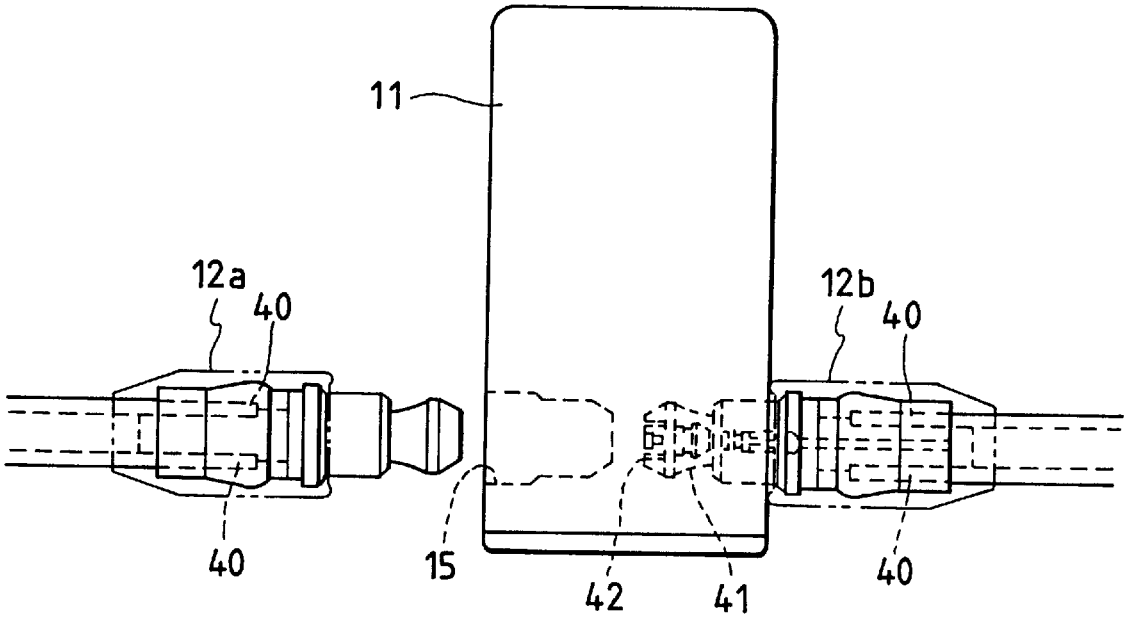
FIG. 11 is an enlarged fragmentary view showing the connection of a lock unit and a coupling member in the theft preventing device illustrated in FIG. 10.
Figure 12A:
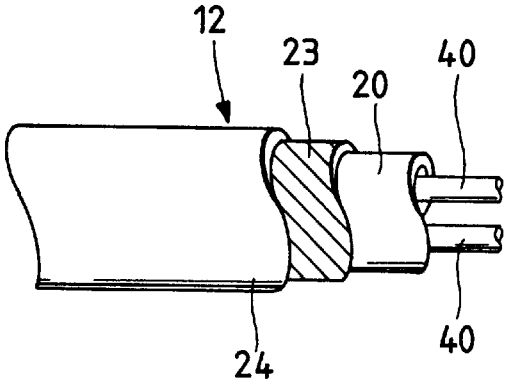
FIGS. 12A and 12B are diagrams for a description of the internal structure of the coupling member in the theft preventing device illustrated in FIG. 10.
Figure 12B:
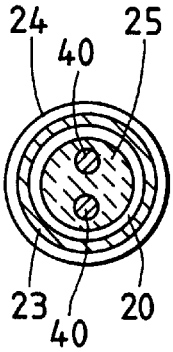

The theft preventing device 10 comprises: a lock unit 11, and a coupling member 12 having terminals 12*a* and 12*b* at both ends which are detachably connected to the lock unit, thus forming a closed loop. A detailed description of the lock unit 11 is omitted here, the lock unit 11 is substantially equal in construction to a bicycle lock disclosed by Unexamined Japanese Utility Model Publication Sho-63-201174/(1988), or a wire lock disclosed by Unexamined Japanese Utility Model Publications Sho-60-11975/(1985) or Hei-5-40561/(1993). When a cylinder lock 16 (FIG. 4) provided in the lock unit 11 is unlocked, latches provided in the lock unit 11 are released, as a result of which the coupling member 12 is separated from the lock unit 11. Each of the terminals 12*a* and 12*b* of the coupling member 12 has a plug 13 with an annular groove 14, while the lock unit 11 has two coupling holes 15 and 15. When the plugs 13 of the coupling member 12 are inserted into the coupling holes 15 of the lock unit 11, the annular grooves 14 of the plugs 13 are engaged with the latches of the lock unit 11; that is, the plugs 3 are prevented from being disengaged from the lock unit 11. As shown in FIG. 4, a key insertion inlet 17 for the cylinder lock 16 is formed in the upper surface 11*a* of the lock unit 11.

Figure 1:
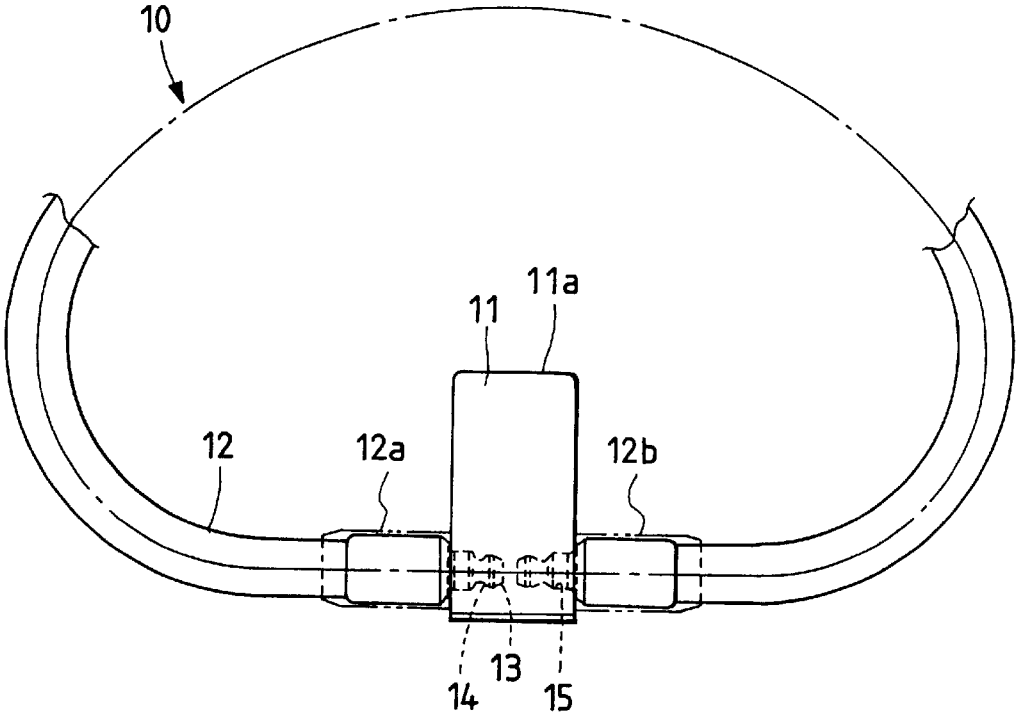
FIG. 1 is a front view showing an example of a theft preventing device, which constitutes a first embodiment of the invention.
Figure 2:
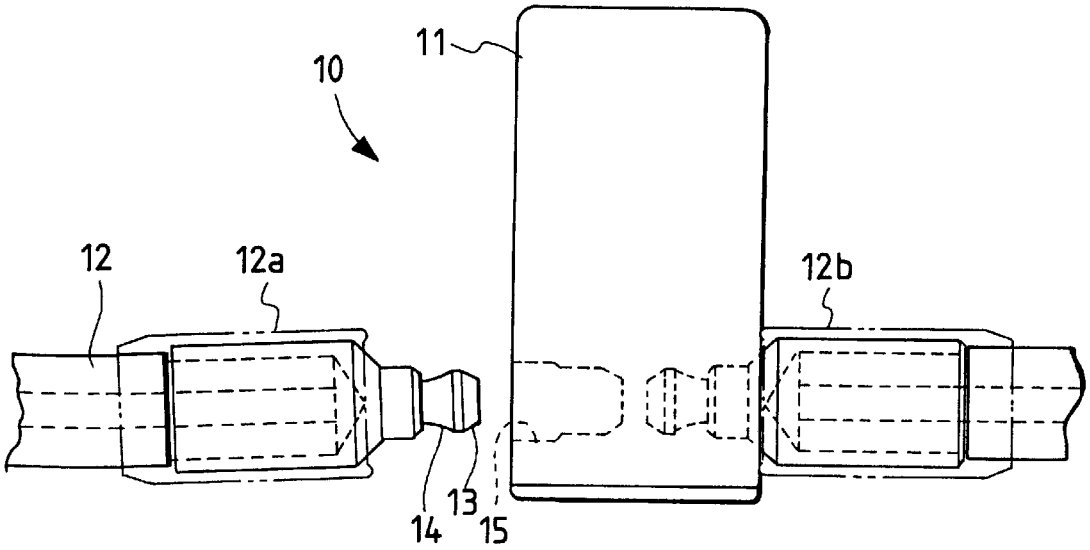
FIG. 2 is an enlarged fragmentary view showing the connection of a lock unit and a coupling member in the theft preventing device illustrated in FIG. 1.
Figure 3A:
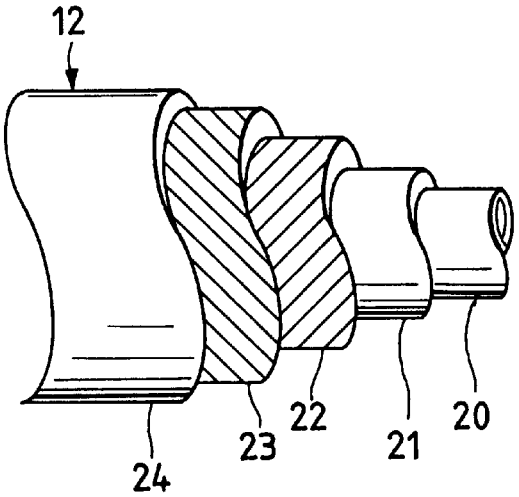
FIGS. 3A and 3B are diagrams for a description of the internal structure of the coupling member in the theft preventing device illustrated in FIG. 1.
Figure 3B:
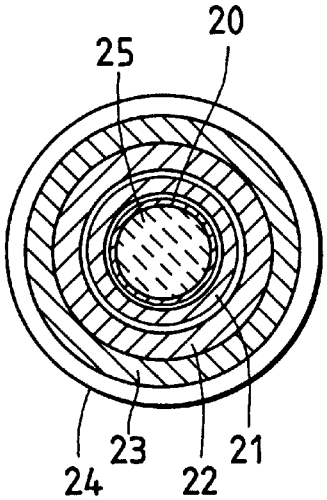

As shown in FIG. 3, the flexible coupling member 12 is made up of: a tube 20; a protective liner layer 21 which is elastic; a steel wire coil layer 22 formed by burying coiled steel wire; a mesh layer 23 in the form of a string made of thin steel wire or fiber; and an outer resin cover layer 24. Those layers 21 through 24 are formed on the tube 20 in the stated order. The tube 20 is filled with a two-liquid fluid 25 at a filling rate of 80 to 90% which is not hazardous to human bodies, containing liquefied petroleum gas (LPG), and paint, dye or pigment, or ink or paint which is mixed in the liquefied petroleum gas. The tube 20 is closed at both ends by welding, so that the fluid 25 is substantially positively held in the tube 2. When the coupling member 20 is cut with a certain tool, immediately the fluid 25 splashes out of the coupling member 20, so that the adhesive material contained in the fluid sticks onto external objects around the device.

Second Embodiment

FIGS. 6 through 9 show another example of the theft preventing device, which constitutes a second embodiment of the invention. In the device, its coupling member 12 is made of metal.

The coupling member 12 includes: a first coupling section 31 made of a solid metal pipe; and a second coupling section 32 which is smaller in diameter than the first coupling section 31. The first coupling section 31 has a plug 31 at one end which is detachably engaged with one of the coupling holes 15 of the lock unit 11, and an engaging recess 31*b* at the other end. The second coupling section 32 has a plugs 32*a* at one end which is detachably engaged with the other coupling hole 15 of the lock unit 11, and a key-type terminal 32*b* at the other end which is inserted into the engaging recess 31*b* of the first coupling section 31. The second coupling section 32 is made of a hollow metal pipe. A fluid containing adhesive material is filled in the internal cavity 32*c* of the second coupling section 32. The plug 32*a* and the key-type terminal 32*b* have threaded portions 33*a* and 33*b*, respectively, which are coupled to the second coupling section 32. Sealing agent is applied to those threaded portions 32*a* and 32*b*, so that the plugs 32*a* and the key-type terminal 32*b* prevent the leakage of the fluid from the second coupling section. The key-type terminal 32*b* includes a valve 34, through which the fluid can be supplied into the internal cavity 32. The valve 34 also functions to prevent the leakage of the fluid due to its back flow. The key-type terminal 32*b* has a pair of lugs 35, while the engaging recess 31*b* of the first coupling section 31 has a pair of cuts 36 and 36. In order to couple the key-type terminal 32*b* to the engaging recess 31*b*, the plug 31*a* of the first coupling section 31 is engaged with the one coupling hole 15 of the lock unit 11. And, with the lugs 35 of the key-type terminal 32*b* passed through the cuts 36 of the engaging recess 31*b*, the key-type terminal is coupled to the engaging recess 31*b*. Under this condition, the second coupling section 32 is turned 90° with respect to the first coupling section 31, and the plug 32*a* of the second coupling section 32 is engaged with the other coupling plug 15 of the lock unit.

Third Embodiment

FIGS. 10, 11, 12*a* and 12*b* show another example of the theft preventing device, which constitutes a third embodiment of the invention. In the theft preventing device, reinforcing wires are inserted into the tube in which fluid is filled.

In the theft preventing device, its coupling member 13 is made up of a tube 20, a mesh layer 23 in the form of a string made of thin steel wire or fiber, and an external resin cover layer 24. Those layers 23 and 24 are formed on the tube 20 in the stated order. A fluid containing adhesive material is filled in the tube 20. Two reinforcing wires 40 are inserted into the tube 20. The end portions of those wires 40 are secured to the terminals 12*a* and 12*b* of the coupling member 20. The terminal 12*b* has a plug 41 which includes a check valve 42.

Fourth embodiment

Figure 13:
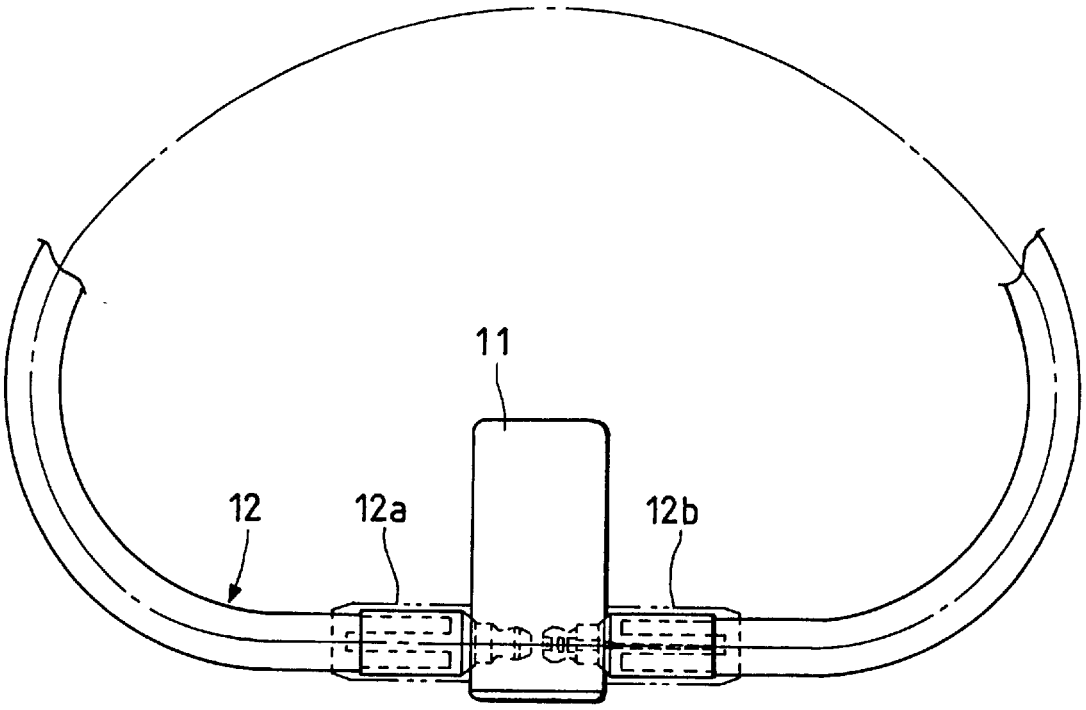
FIG. 13 is a front view showing another example of the theft preventing device, which constitutes a fourth embodiment of the invention.
Figure 14A:
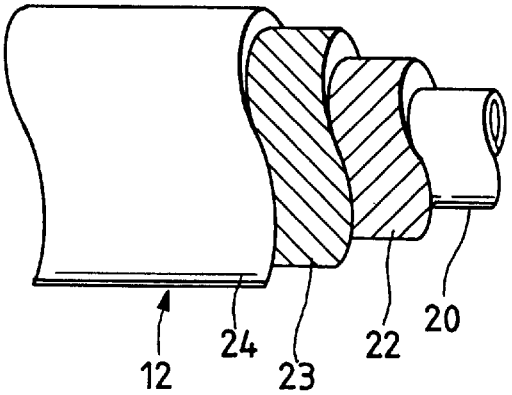
FIGS. 14A and 14B are diagrams for a description of a coupling member in the theft preventing device illustrated in FIG. 13.
Figure 14B:
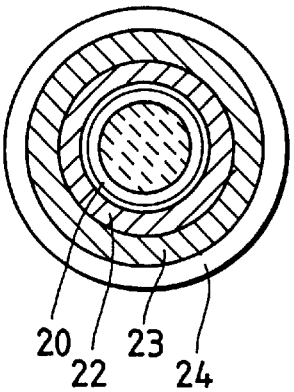
Figure 15:
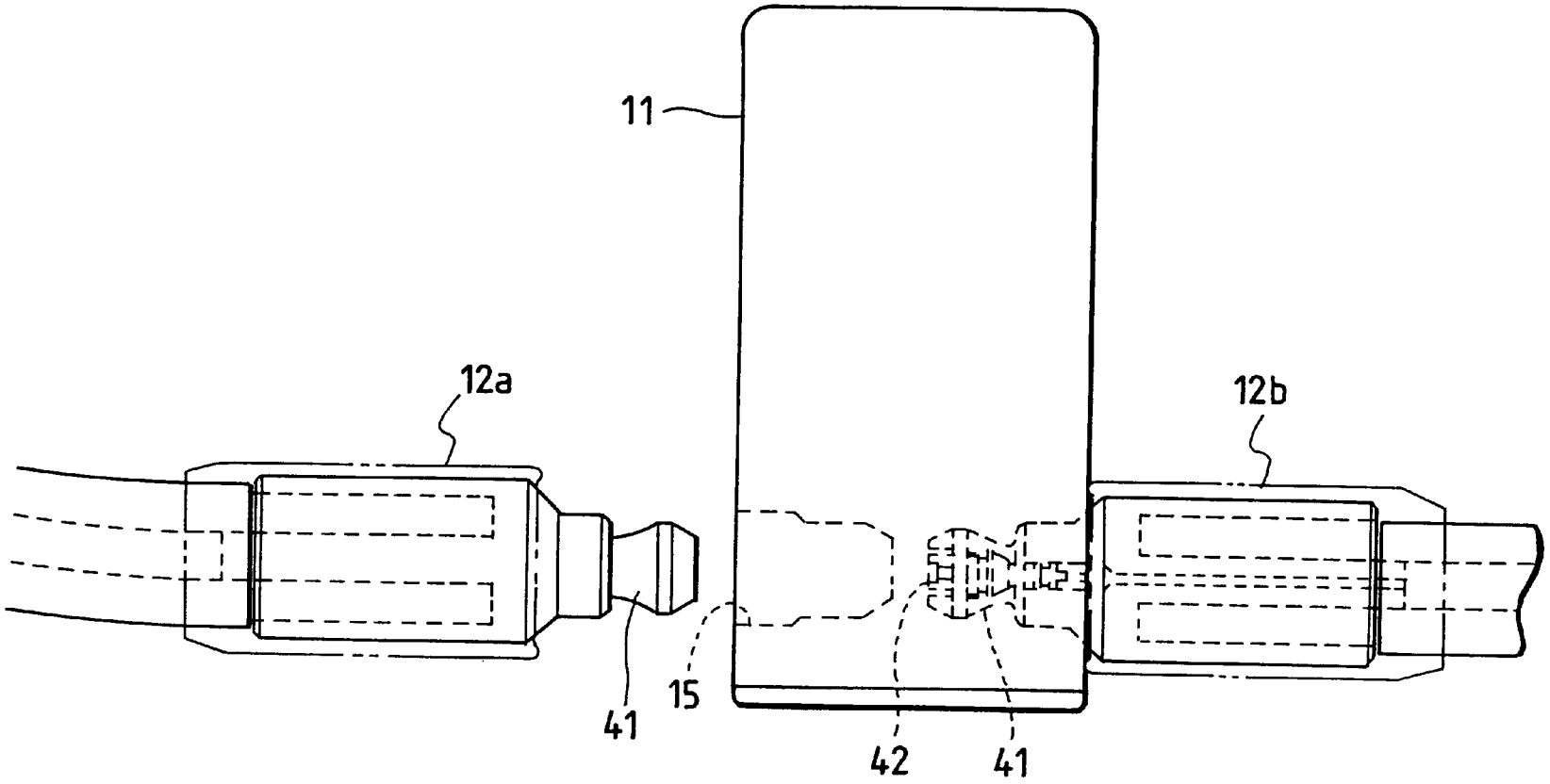
FIG. 15 is an enlarged fragmentary view for a description of the connection of the coupling member and a lock unit in the theft preventing device illustrated in FIG. 13.

FIGS. 13, 14 and 15 show another example of the theft preventing device, which constitutes a fourth embodiment of the invention. In the theft preventing device, liquid and gas are filled in the tube.

In the theft preventing device, its coupling member 12 is made up of a tube 20, a steel wire coil layer 22 formed by burying coiled steel wire, a mesh layer 23 in the form of a string made of thin steel wire or fiber, and an outer resin cover layer 24. Those layers 22 through 24 are formed on the tube 20 in the stated order. The tube 20 is filled with liquefied petroleum gas (LPG) and smelly gas. Its terminal 12*b* has a plug 41 which includes a check valve 42.

Fifth Embodiment

Figure 16A:
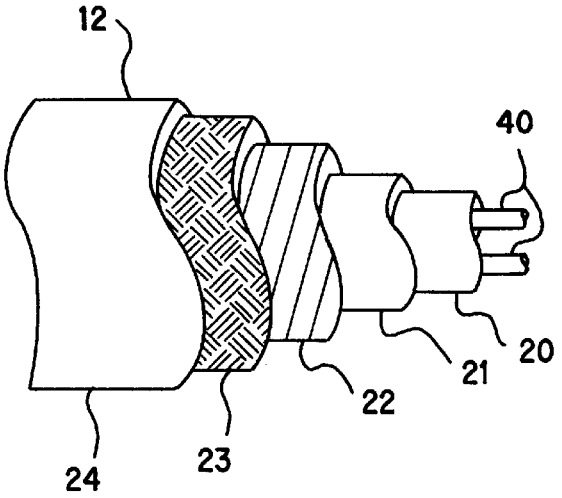
FIGS. 16*a* and 16*b* are diagrams for the description of the internal structure of a fifth embodiment.
Figure 16B:
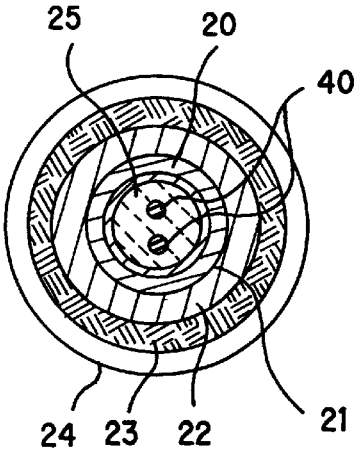

FIGS. 16*a* and 16*b* show another example of the internal structure of the theft preventing device which constitutes a fifth embodiment of the invention. In this embodiment, the coupling member 12 is made up of a tube 20, a protective liner layer 21 which is elastic, a steel wire coil layer 22 formed by burying coiled steel wire, a mesh layer 23, and an outer resin cover layer 24. A fluid containing adhesive material is filled in the tube 20. Two reinforcing wires 40 are inserted into the tube 20.

If, in any one of the second through fourth embodiments, the coupling member 12 engaged with the lock unit 11 is unlawfully damaged by a person, the fluid containing the adhesive material is splashed out, so that the adhesive material sticks onto him. Therefore, from detection of the adhesive material, it can be determined who has broken it, and it can be confirmed that the lock unit has been locked.

While the invention has been described with reference to its preferred embodiments, it should be noted that the invention is not limited thereto or thereby. For instance, the theft preventing device may be so modified that one of the terminals of the coupling member is fixedly secured to the lock unit, and only the other terminal is detachably engaged with the lock unit. Furthermore, it may be so modified that the plug 32*a* of the second coupling section 32 is detachably and rotatably coupled to the other coupling hole 15 of the lock unit 11, and the key-type terminal 31*b* of the second coupling section 32 is rotatably engaged with the engaging recess 31*b* of the first coupling section 31.

As was described above, with the theft preventing device of the invention, it can be determined who has broken the coupling member which is engaged with the lock unit while forming a loop. Hence, the theft preventing device is prevented from being unlawfully damaged, and it can be confirmed that the lock unit has been locked.

What is claimed is:

1. A theft preventing device comprising:

a lock unit having two coaxial coupling holes; and a coupling member comprising a multi-layered tube having at least three layers including a protective liner layer and a reinforcement layer and an outer resin cover layer which are formed on said tube in the stated order, said coupling member having terminals at both ends which are coupled to said lock unit in such a manner that said coupling member is in the form of a loop, at least one of said terminals being separable from said lock unit;

wherein the inside of said coupling member is filled with a fluid including adhesive material, so that, when said coupling member is damaged, said fluid is splashed out of said coupling member;

each of said terminals of said coupling member has a plug with an annular groove, said plug of said at least one of said terminals being detachably connected to one of said coupling holes and being rotatable therein; and one of said terminals includes a check valve.

2. A theft preventing device as claimed in claim 1, wherein said tube is filled with said fluid.

3. A theft preventing device as claimed in claim 1, wherein said reinforcement layer comprises a steel wire layer, and a mesh layer.

4. A theft preventing device as claimed in claim 1, wherein said coupling member comprises:

a first coupling section made of metal; and a second coupling section smaller in diameter than said first coupling section;

said first coupling section having one end which is said at least one terminal and is detachably connected to said one of said coupling holes of said lock unit, and an engaging recess at the other end; and said second coupling section having one end which is detachably connected to the other coupling hole of said lock unit, and a key-type terminal at the other end which is inserted into said engaging recess of said first coupling member.

5. A theft preventing device as claimed in claim 4, wherein said first coupling section is made of solid metal.

6. A theft preventing device as claimed in claim 4, wherein, when said fluid is supplied into said second coupling section through a valve provided in said key-type terminal of said second coupling section, said end of said second coupling section prevents the leakage of said fluid from said second coupling section.

7. A theft preventing device as claimed in claim 4, wherein said key-type terminal has a pair of lugs, while said engaging recess of said first coupling section has a pair of cuts, and said plug of said first coupling section is engaged with the one coupling hole of said lock unit, said key-type terminal is inserted into said engaging recess, thereafter said second coupling section is turned with respect to said first coupling section, and said plug of said second coupling section is engaged with the other coupling hole of said lock unit.

8. A theft preventing device as claimed in claim 1, wherein said tube is filled with said fluid, and a reinforcing wire is inserted into said tube.

9. A theft preventing device as claimed in claim 1, wherein said fluid is one of liquefied petroleum gas (LPG) and smelly gas, and said adhesive material is one of paint, dye and pigment.

* * * * *